United States Patent [19]

Matsui et al.

[11] 4,246,744

[45] Jan. 27, 1981

[54] PNEUMATIC YARN SPLICING APPARATUS

[75] Inventors: Isamu Matsui; Shigeru Takasaki, both of Kyotoshi; Hiroshi Mima, Joyoshi, all of Japan

[73] Assignee: Murata Kikai Kabushiki Kaisha, Japan

[21] Appl. No.: 19,418

[22] Filed: Mar. 12, 1979

[30] Foreign Application Priority Data

Mar. 17, 1978 [JP] Japan ..... 53-31251

[51] Int. Cl.[3] ..... D01H 15/00

[52] U.S. Cl. ..... 57/22; 57/261; 242/35.6 R

[58] Field of Search ..... 57/22, 23, 261; 242/35.6 R

[56] References Cited

U.S. PATENT DOCUMENTS

| | | | |
|---|---|---|---|
| 3,311,312 | 3/1967 | Hauri | 242/35.6 R |
| 3,581,486 | 6/1971 | Dibble | 57/22 |
| 3,822,538 | 7/1974 | Cardell | 57/22 |
| 3,918,651 | 11/1975 | Uchida | 242/35.6 R |
| 4,002,012 | 1/1977 | Norris | 57/22 |
| 4,143,506 | 3/1979 | Pierce et al. | 57/22 |

FOREIGN PATENT DOCUMENTS

| | | | |
|---|---|---|---|
| 956992 | 4/1964 | United Kingdom | 57/22 |

*Primary Examiner*—Donald Watkins

*Attorney, Agent, or Firm*—Whittemore, Hulbert & Belknap

[57] ABSTRACT

This apparatus is used for splicing the ends of the spun yarn by inserting the yarn ends into an air jet nozzle having one or a plurality of air jet pipes, in which they are doubled and subjected to an air jet to join each other. Yarn end cutting and holding devices for the top yarn and the bottom yarn are disposed at the both ends of a yarn inserting hole of the air jet nozzle. An automatic yarn inserting device may be provided with the apparatus to introduce the yarn ends into the yarn inserting hole and into the yarn end cutting and holding devices.

10 Claims, 15 Drawing Figures

PNEUMATIC YARN SPLICING APPARATUS

FIELD OF THE INVENTION

The present invention relates to a pneumatic yarn splicing apparatus and specially relates to the apparatus for a spun yarn. The yarn splicing apparatus of the present invention comprises an air jetting nozzle for applying a jetted air to the yarn ends being arranged and doubled, a device for introducing the yarn ends into the air jetting nozzle, and a device for holding the yarn ends in such a state that the good splicing of the yarns is effected.

BACKGROUND OF THE INVENTION

As the method for connecting yarn ends, there are ordinarily adopted methods using a Weaver's knotter, a Fisherman's knotter or the like. According to these methods, however, sizes of knots are very large and are about 3 times the yarn sizes. Accordingly, yarns having these knots are entangled with each other at the manufacturing step, and these knots are caught at the subsequent step, resulting in occurrence of yarn breakages or formation of defects in the final knitted or woven fabrics. Therefore, there is inevitably caused a defect that the commerical value of products is lowered.

The present invention is to eliminate the foregoing defects involved in the conventional techniques.

SUMMARY OF THE INVENTION

An object of the present invention is to provide an apparatus for producing a novel spliced joint of spun yarn by applying a jetted air to the ends of the spun yarns.

Another object of the present invention is to provide a new structure of an air jetting nozzle which is preferable to applying a jetted air to the ends of yarns.

Further object of the present invention is to provide a device for introducing the yarn ends into the air jetting nozzle and for holding the yarn ends in the nozzle in such a state that the good splicing of the yarns is effected.

According the present invention the yarn ends introduced into the air jetting nozzle are spliced each other without transferring of the spliced joint due to the imparted jetting air stream and a tightly jointed portion is formed.

Other and farther objects, features and advantages of the invention will appear more fully from the following description.

DETAILED DESCRIPTION OF PREFERRED EMBODIMENT

The apparatus of the present invention will now be described by reference to the accompanying drawing.

Figure 1:
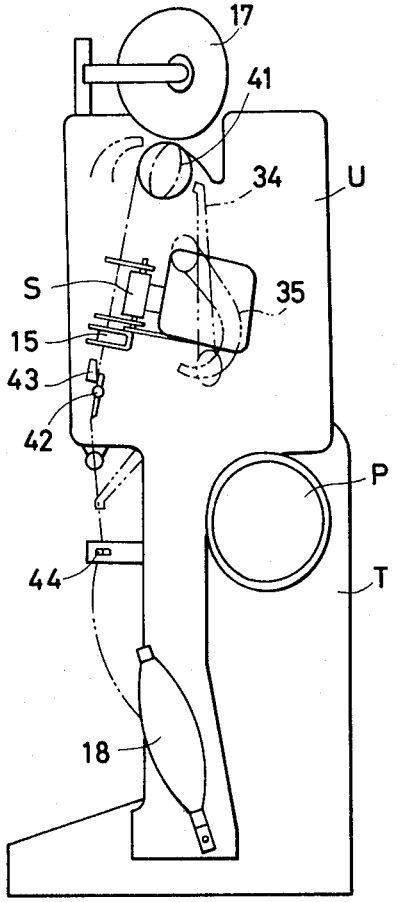
FIG. 1 is a schematic side view showing a yarn winder.

Referring to FIG. 1 which shows a schematic view of a yarn winder, a winding unit U is fixed to a frame T, and compressed air is filled in a hollow pipe P extending along the entire spindles.

A suction mouth 35 is disposed to take up the end of a top yarn from a package 17 frictionally driven by a drum 41 and guide it to a yarn splicing device S described below and a slub catcher 15. A relay pipe 34 is disposed to suck and hold the end of a bottom yarn on the side of a bobbin 18 and guide it to the yarn splicing device S and slub catcher 15. A yarn breakage sensing filler 42 is arranged so that it can be displaced by yarn breakage to press a microswitch 43, whereby yarn breakage is sensed.

Compressed air is supplied to air jet nozzles of respective spindles described below through compressed air supply pipes from the above hollow pipe P in which compressed air is filled.

The yarn splicing device S comprises an air jet nozzle 1, yarn end cutting and holding devices 2 and 3 and an automatic yarn inserting device including a fixed guide member and a movable guide member. The respective members will now be described in detail.

Figure 2:
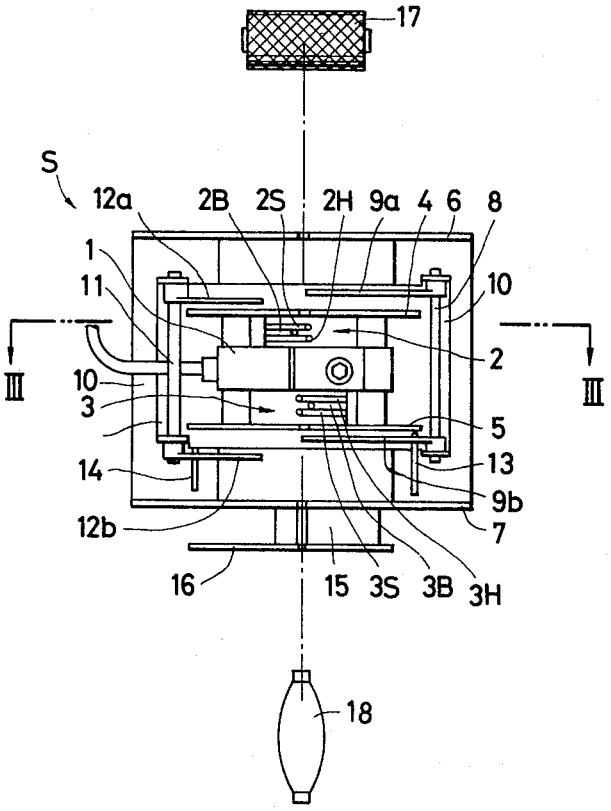
FIG. 2 is a front view illustrating diagrammatically one embodiment of an apparatus of the present invention.
Figure 3:
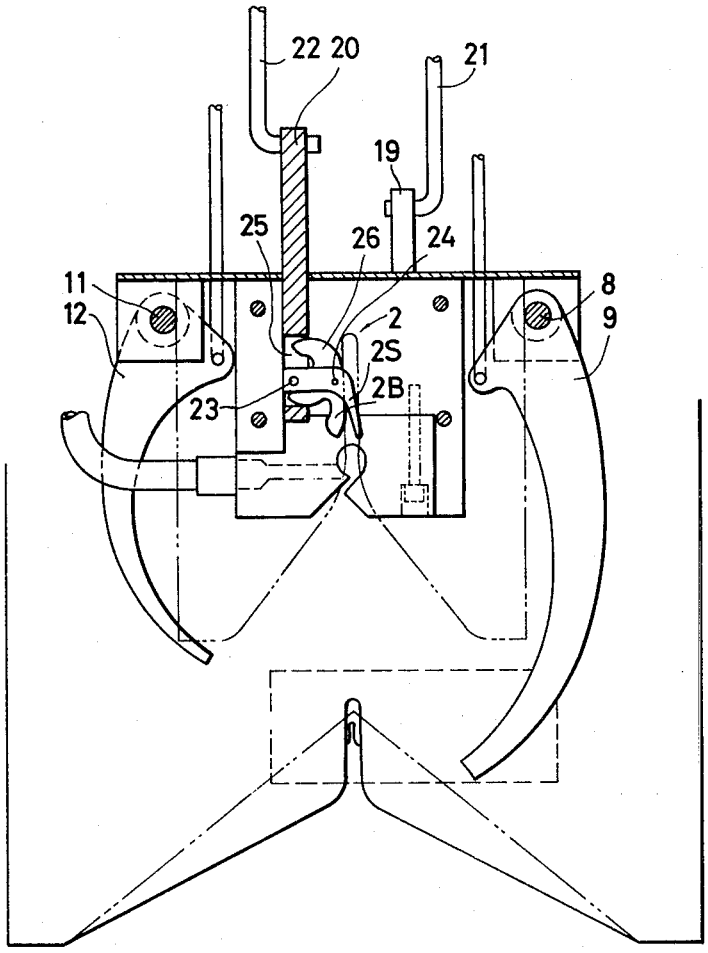
FIG. 3 is a sectional view taken along the line III—III of FIG. 2.

Referring to FIGS. 2 and 3, yarn end cutting and holding devices 2 and 3 are disposed above and below the air jet nozzle 1, and yarn guide plates 4 and 5 are disposed above and below the yarn cutting and holding devices 2 and 3 and another yarn guide plates 6 and 7 are disposed above and below the yarn guide plates 4 and 5. These guide plates 4, 5, 6 and 7 are fixed on a unit constituting the fixed guide member. Yarn pressers 9*a* and 9*b* turnably supported on a frame 10 by a shaft 8 disposed on the right side of the nozzle in FIGS. 2 and 3 and yarn pressers 12*a* and 12*b* turnably supported on the frame 10 by a shaft 11 disposed on the left side of the nozzle in FIGS. 2 and 3 are arranged between the yarn guide plates 4 and 6 and between the yarn guide plates 5 and 7 respectively. The yarn pressers 9*a* and 9*b* are turned through a rod 13 by a knotter cam and the yarn pressers 12*a* and 12*b* are turned through a rod 14 by the knotter cam. These yarn pressers 9*a*, 9*b*, 12*a* and 12*b* constitute the movable guide member of the automatic yarn inserting device.

Figure 4:
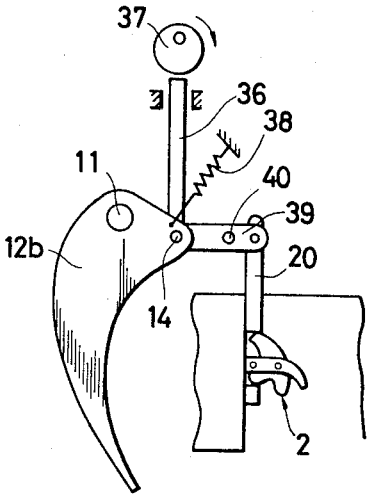
FIG. 4 is a partial view illustrating one embodiment of a driving means for a yarn end cutting and holding device.

Referring to FIG. 4, a lever 36 is connected to the rod 14 freely fitted in the yarn presser 12*b* which can turn with a shaft 11 being as the center and the end portion of the lever 36 is pressed to the circumference of an eccentric cam 37 by a spring 38. Another lever 39 is connected to the rod 14 so that it can turn with a shaft 40 being as the center. An operation lever 20 for operating the yarn end cutting and holding device 3 is supported on the end portion of the lever 39.

Accordingly, with turning of the yarn presser 12*b* by the driving action of the eccentric cam 37, the yarn end cutting and holding device 3 is operated co-operatively with the yarn presser 12*b* through the lever 39 and operation lever 20.

Since the yarn presser 9 and yarn end cutting and holding device 3 are not arranged co-operatively with each other in the present embodiment, they are independently acutated by different instructions.

The co-operative mechanism for the yarn presser 12 and yarn end cutting and holding device 3 is not limited to one illustrated in FIG. 4, but other various mechanisms can be adopted in the present invention.

The yarn pressers 9 and 12 are disposed as the movable guide member, and the top yarn end Y2 taken out from a package 17 and the bottom yarn end Y1 taken out from a bobbin 18 by means of the above-mentioned guide plates 4 and 5 and guide plates 6 and 7 are automatically inserted into the air jet nozzle 1. The automatic yarn inserting device is thus constructed. An electronic slub catcher 15 is fixed to the lower face of the yarn guide plate 7 and a yarn guide plate 16 is fixed to the lower face of the slub catcher 15. Reference numerals 17 and 18 represent a package and a bobbin, respectively.

In FIG. 3, the yarn pressers 9*a* and 9*b* have a similar shape and the yarn pressers 12*a* and 12*b* have a similar shape. Accordingly, they are representatively indicated by 9 and 12. Bill operating levers 19 and 20 are vertically moved through rods 21 and 22 by a knotter cam (not shown). Each of the yarn end cutting and holding devices 2 and 3 comprises a bill head 2H or 3H, a bill blade 2B or 3B and a bill spring 2S or 3S. The bill heads 2H and 3H and the bill springs 2S and 3S are fixed to each other through a screw 23 and a pin 24. The bill blades 2B and 3B are arranged rotatably to the bill heads 2H and 3H and bill springs 2S and 3S through the pin 24.

A ⊐-shaped recess 25 is formed on the bill operating levers 19 and 20 and a vane portion 26 of the bill blade is fitted in the recess 25. Accordingly, in FIG. 3, when the operation levers 19 and 20 are vertically moved, the bill blades 2B and 3B are turned with the pin 24 being as the fulcrum. In FIG. 3, the state where the yarn end cutting and holding device 2 is opened is illustrated. When the bill blade 2B is closed, the yarn is cut between the bill blade 2B and bill spring 2S and the cut yarn ends are held between the bill blade 2B and bill head 2H.

Figure 5A:
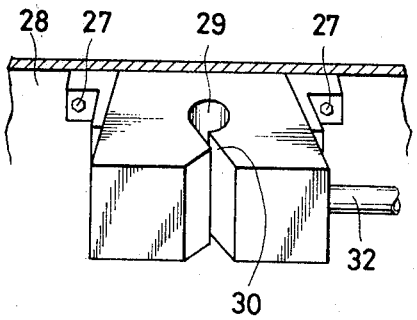
FIG. 5*a* is a perspective view illustrating one embodiment of the air nozzle.
Figure 5B:
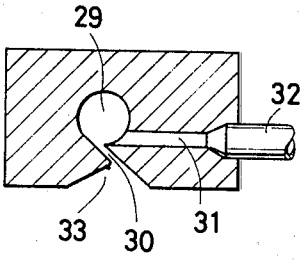
FIG. 5*b* is a sectional view of the air nozzle in FIG. 5*a;*

As shown in FIGS. 5*a*, 5*b*, the air jet nozzle is fixed onto a bracket 28 by a bolt 27, and a yarn inserting hole 29 is connected to a V-shaped yarn inserting guide portion on the front face through a yarn inserting slit 30 extending in the tangential direction of the hole 29. An air jet pipe 31 is connected to the hole 29 in a direction rectangular to the axial direction of the hole 29 and tangential to the hole 29. Compressed air supplied from an air feed pipe 32 is jetted into the hole 29 from the jet pipe 31 to form a swirling air stream in the hole 29. The direction of communication of a guide portion 33 of the yarn inserting slit 30 with the hole 29 is set as the direction of the swirling air stream. By this arrangement, undesirable escape of the yarn from the hole 29 to the slit 30 at the time of forming the swirling air stream can be prevented. In the above embodiment, the air jet pipe is disposed at one point. Of course, a plurality of air jet pipes may be disposed in the tangential direction. Further, the nozzle structure is not limited to one having a cylindrical hole, and even if the nozzle is changed so that the rotation efficiency, air utilizing efficiency or air discharging efficiency can be enhanced, this change is not deviated from the gist of the present invention.

Figure 6:
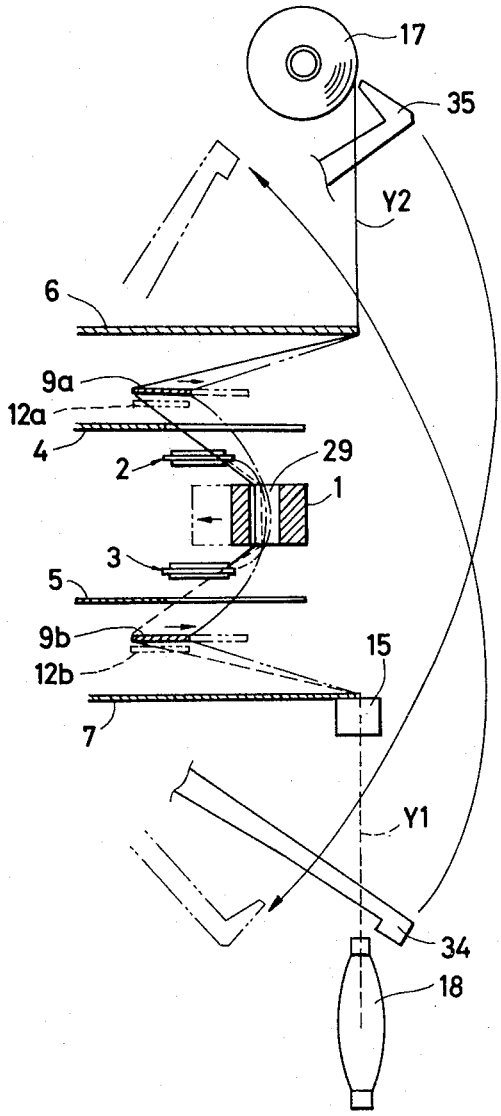
FIG. 6 is a side view, partly in section, showing the positional relationship of respective elements of the apparatus of FIG. 2; and FIGS. *7a, 7b, 7c, 7d, 7e, 7f, 7g* and *7h* are diagrams illustrating the operation of elements of the yarn end cutting and holding device for the yarn splicing process.

The yarn guide plates 4, 5, 6 and 7, the yarn pressers 9 and 12 and the yarn end cutting and holding devices 2 and 3 are arranged as shown in FIG. 6. A bottom yarn Y1 taken out from the bobbin 18 and a top yarn Y2 taken out from the package 17 are inserted through the relay pipe 34 and the suction pipe 35, respectively, along slits formed on apexes of V-shaped guide faces defined by the guide plates 6 and 7 and guide plates 4 and 5 into the hole 29 of the nozzle 1 and the yarn end cutting and holding devices 2 and 3.

The yarn splicing operation by the apparatus having the above-mentioned structure will now be described in detail.

Referring to FIGS. 6 and 7, the relay pipe 34 sucks and holds the end of the yarn from the bobbin 18 and turns as shown in FIG. 6 to insert the bottom yarn Y1 into the electronic slub catcher 15 and between the guide plates 6 and 7. Then, in the state where the yarn end cutting and holding device 2 is opened and the yarn end cutting and holding device 3 is closed, the yarn presser 9 is turned in the clockwise direction in FIG. 3 with the shaft 8 being as the center to introduce the bottom yarn Y1 into the opened yarn end cutting and holding device 2 and the hole 29 of the nozzle 1 (FIG. 7*a*). In FIGS. 7*a* to 7*h*, the yarn end cutting and holding devices 2 and 3 are diagrammatically illustrated, and in FIG. 7*a*, the state where the yarn end cutting and holding device 2 is opened and the yarn end cutting and holding device 3 is closed is shown and the same holds in subsequent Figures.

Figure 7A:
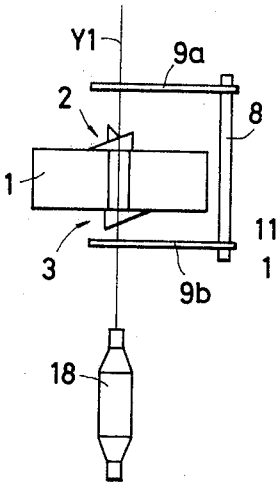
Figure 7B:
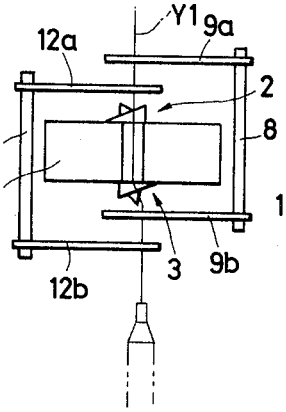
Figure 7C:
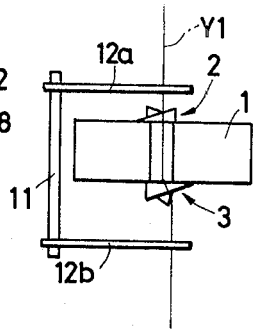

Then, the yarn presser 12 is turned in the counter-clockwise direction with the shaft 11 being as the center and the yarn end cutting and holding device 3 is opened. Simultaneously, the bottom yarn Y1 is pressed by the yarn presser 12, and the yarn presser 9 is returned to the original position (FIGS. 7*b* and 7*c*). At this point, the yarn presser 12 co-operated with the yarn end cutting and holding device 3 so that with turning of the yarn presser 12, the yarn end cutting and holding device 3 is opened.

Figure 7D:
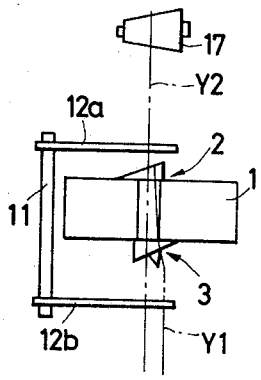

Then, the suction mouth 35 is turned to the position indicated by the chain line in FIG. 6 while sucking and holding the end of the yarn from the package 17, and the top yarn Y2 is inserted between the guide plates 6 and 7. At this point, the bill blade 2B of the yarn end cutting and holding device 2 is closed to cut and hold the end of the bottom yarn (FIG. 7*d*). Then, the yarn presser 9 is turned again and the yarn presser 12 is returned to the original position, and the bill blade 3B of the yarn end cutting and holding device 3 is closed to cut and hold the end of the top yarn (FIG. 7*e*).

Accordingly, the end of the bottom yarn is held by the yarn end cutting and holding device 2 and is bent between the nozzle 1 and guide plate 7 by the yarn presser 9. The end of the top yarn is held by the yarn end cutting and holding device 3 and is bent between the nozzle 1 and guide plate 6 by the yarn presser 9. Thus, both the yarn ends are ready for air jetting.

Figure 7E:
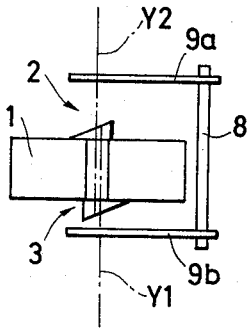
Figure 7F:
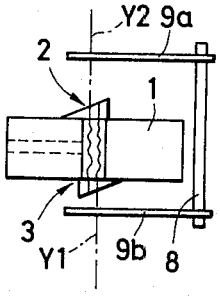
Figure 7G:
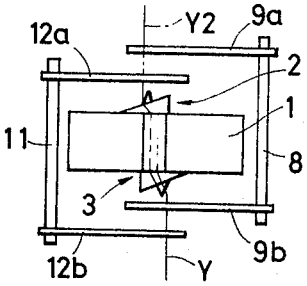

In the state shown in FIG. 7*e*, the yarn presser 9 is slightly returned to slightly slacken both the top and bottom yarns, and simultaneously, compressed air is jetted into the hole 29 of the nozzle 1 to form a violent swirling air stream in the hole 29 and effect yarn splicing (FIG. 7*f*). When the so formed swirling air stream is caused to act on the ends of the top and bottom yarns held by the yarn end cutting and holding devices 2 and 3, they are spliced to each other with good entanglement without escape of the spliced portion. Further, in the above apparatus, since air is jetted to the slightly slackened yarns, rotation of the yarns is enhanced and entanglement between the top and bottom yarns is promoted, whereby tight splicing can be attained. Of course, it is possible to adopt a modification where the nozzle 1 per se is slightly moved to slacken the yarns.

Figure 7H:
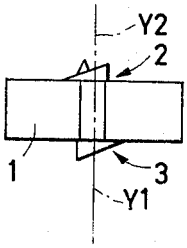

On completion of the yarn splicing operation, the yarn presser 12 is turned to open the yarn end cutting and holding device 3 and the yarn end cutting and holding device 2 is opened (FIG. 7*g*) so that holding of the top and bottom yarns is released. After the yarn pressers 9 and 12 are returned to the original positions, winding is started. (FIG. 7*h*).

As will be apparent from the foregoing illustration, in the apparatus of the present invention, by bending the bottom yarn from the bobbin and the top yarn from the package, which are inserted into the nozzle, and holding and fixing them by the yarn end cutting and holding devices, both the yarns can be tightly entangled with each other in the nozzle without shifting of the spliced portion by air jetting. Namely, when the two yarns are subjected to air jetting in the nozzle without being held, the spliced portion is shifted to a direction where twists are readily formed by air jetting and control of formation of twists is difficult. Accordingly, no good spliced portions can be formed. On the other hand, by conducting air jetting while holding the yarn ends as in the present invention, tight spliced portions can be formed stably without escape of the spliced portions. Further, the top and bottom yarns may be held in the doubled state in each of the yarn end cutting and holding devices 2 and 3. Still further, when one yarn end cutting and holding device is released during air jetting and one yarn end is set free, fibers are scattered from the yarn end face and the size of the spliced portion can be freely controlled. This is another advantage of the present invention.

What is claimed is:

1. Yarn splicing apparatus comprising an air jet nozzle having an elongated yarn inserting hole into which spun yarn ends are introduced, a yarn inserting slit extending in the tangential direction of the yarn inserting hole, and a V-shaped yarn inserting guide portion connecting with the yarn inserting slit and air jet means communicating with the hole to create a swirling air stream therein, and a yarn end cutting and holding device disposed at at least one end of the yarn inserting hole.

2. Yarn splicing apparatus as set forth in claim 1, including a yarn inserting device which puts the air jet nozzle and the yarn end cutting and holding devices between it to introduce the ends of the yarn into the yarn inserting hole and into the yarn end cutting and holding devices.

3. Yarn splicing apparatus as set forth in claim 2, wherein the air jet means comprises at least one air jet pipe connected to the yarn inserting hole for supplying compressed air in a direction perpendicular to the axial direction of the yarn inserting hole and tangential to the hole.

4. Yarn splicing apparatus as set forth in claim 2, wherein the yarn inserting device comprises a fixed yarn guide member and a movable yarn guide member capable of moving toward said fixed guide member.

5. Yarn splicing apparatus as set forth in claim 4, wherein first fixed yarn guide plates are disposed above and below the yarn end cutting and holding devices as the fixed yarn guide member of the yarn inserting device.

6. Yarn splicing apparatus as set forth in claim 4, wherein said movable yarn guide member of the yarn inserting device is a pair of yarn pressers disposed on the left and right of the air jet nozzle respectively and the yarn presser has two arms extending above and below the air jet nozzle and can turn with a shaft disposed in parallel with the axis of the yarn inserting hole being as the center.

7. Yarn splicing apparatus as set forth in claim 6, wherein said yarn pressure is arranged to be turned putting the first fixed yarn guide plates, the yarn end cutting and holding devices and the air jet nozzle between the arms thereof.

8. Yarn splicing apparatus as set forth in claim 4, wherein second fixed yarn guide plates are further disposed above and below the yarn pressers as the fixed yarn guide member of the yarn inserting device so that large bendings are subjected to the ends of the top and bottom yarns which are inserted into the air jet nozzle, and the tension of the top and bottom yarns is maintained to be constant.

9. Yarn splicing apparatus comprising an air jet nozzle having an elongated yarn inserting hole into which spun yarn ends are introduced, air jet means communicating with the hole to create a swirling air stream therein, a yarn end cutting and holding device disposed at at least one end of the yarn inserting hole including a bill head, a bill blade and a bill spring, said bill head and said bill spring being fixed to each other and said bill blade being supported rotatably between the bill blade and the bill spring so that the yarn end is cut between the bill blade and the bill spring on the operation of opening or closing the bill blade and the cut yarn end is held between the bill head and the bill blade and a yarn inserting device for putting the air jet nozzle and the yarn end cutting and holding devices between it to introduce the ends of the yarn into the yarn inserting hole and into the yarn end cutting and holding devices.

10. Yarn splicing apparatus comprising an air jet nozzle having an elongated yarn inserting hole into which spun yarn ends are introduced, air jet means communicating with the hole to create a swirling air stream therein, a yarn end cutting and holding device disposed at at least one end of the yarn inserting hole including a bill head, a bill blade and a bill spring, said bill head and said bill spring being fixed to each other and said bill blade being supported rotatably between the bill blade and the bill spring so that the yarn end is cut between the bill blade and the bill spring on the operation of opening or closing the bill blade and the cut yarn end is held between the bill head and the bill blade.

* * * * *